US007768185B2

(12) United States Patent
Lin et al.

(10) Patent No.: US 7,768,185 B2
(45) Date of Patent: Aug. 3, 2010

(54) ELECTRODELESS LIGHT SOURCE FROM CONDUCTING INORGANIC CARBIDE

(75) Inventors: Kuan-Jiuh Lin, No. 108, Hsin-Hua Street, Taichung City (TW); Jun-Wei Su, Chia-Yi (TW)

(73) Assignee: Kuan-Jiuh Lin, Taichung (TW)

( * ) Notice: Subject to any disclaimer, the term of this patent is extended or adjusted under 35 U.S.C. 154(b) by 493 days.

(21) Appl. No.: 11/388,954

(22) Filed: Dec. 28, 2005

(65) Prior Publication Data

US 2007/0069653 A1 Mar. 29, 2007

(30) Foreign Application Priority Data

Sep. 27, 2005 (TW) ..... 94133596 A

(51) Int. Cl.
*H01J 17/26* (2006.01)

(52) U.S. Cl. ..... 313/231.01

(58) Field of Classification Search ..... 313/231.01
See application file for complete search history.

(56) References Cited

U.S. PATENT DOCUMENTS

| | | | | |
|---|---|---|---|---|
| 4,427,921 | A * | 1/1984 | Proud et al. | 315/248 |
| 6,250,984 | B1 * | 6/2001 | Jin et al. | 445/51 |
| 6,628,079 | B2 * | 9/2003 | Golkowski et al. | 315/39.51 |
| 6,664,728 | B2 * | 12/2003 | Pavlovsky et al. | 313/495 |
| 2005/0175885 | A1 * | 8/2005 | Imholt et al. | 429/40 |

* cited by examiner

*Primary Examiner*—Vip Patel
(74) *Attorney, Agent, or Firm*—Charles E. Baxley

(57) ABSTRACT

The present invention discloses a new type of electrodeless light sources, which can be achieved by radiating microwave on an inorganic carbide with electrical conductivity. The inorganic carbide can be carbon nanotubes (CNTs), or graphite-related fiber materials with well-order crystalline structure. The inorganic carbides of the present invention also emit high-brightness white light source in low vacuum condition (less than 10 torr) and induce plasma gas discharge emission in the presence of a trace of inert gas molecules such as nitrogen and argon. The electrodeless light source of the present invention not only emits high-brightness light emissions but also performs low thermal-radiation conversion.

5 Claims, 7 Drawing Sheets

ELECTRODELESS LIGHT SOURCE FROM CONDUCTING INORGANIC CARBIDE

BACKGROUND OF THE INVENTION

1. Field of the Invention

The present invention relates to a new type of electrodeless light sources, particularly focused on conducting inorganic carbide materials that ignites a brilliant light emission by using microwave radiation.

2. Related Prior Arts

Since the discovery of Edison's incandescent lamp, fluorescent lamps and solid state light sources have become the mainstream lighting technology in homes, offices, and public places1. Especially, LED white-light sources are of interest and potential importance for use in illumination, display, and imaging2. Fundamentally, a smart white-light system can be formed by mixing RGB trichromatic colors from the visible spectrum of red (630-700 nm), green (520-570 nm), and blue (460-490 nm) wavelengths. However, we are not ware of any advanced solid-state materials that emitted simultaneously individual RGB lighting sources. Moreover, the development of natural white-light sources close to the sunlight is still a great challenge.

Moreover, electrodeless light source is another alternative for energy saving consideration. For example, electrodeless sulfur lamp is high-brightness white-light source that contains sulfur and Ar in a quartz bulb. By radiating microwave on the sulfur powders, lighting source is emitted from sulfur and high thermal-radiation is generated simultaneously. Unfortunately, the thermal-radiation becomes one the critical factors for determining the commercial viability of the electrodeless processing.

Therefore, it is desired to find an electrodeless light source with highly luminous efficiency, good color rendering capability, and low thermal-radiation, which is well suited for developing better illumination and display applications.

SUMMARY OF THE INVENTION

The object of the present invention is to provide an electrodeless light source, which can emit high-brightness light and perform low thermal radiation.

The electrodeless light source of the present invention is primarily achieved by radiating microwave on inorganic carbide materials with high electric conductivity. Additionally, the carbides usually have a well-ordered crystalline structure. Accordingly, the conductive carbide materials can be carbon nanotubes (CNTs), carbon fiber, bamboo carbon fiber, high conductive graphite, one-dimensioned carbon nanowire, preferably with an outer diameter ranging 10~100 nm.

The electrically conductive inorganic carbides of the present invention can be placed in vacuum flask (generally less than 10 torr), and emit high-brightness white light. Alternatively, the flask-lamps can be filled with a trace of gas (for example, $N_2$ and inert gas Ar) in which the electrically conductive inorganic carbides induce plasma gas discharge emission in the radiation of microwave.

The microwave applied in the present invention is preferably controlled at 1~1,000 watt per gram of the inorganic carbide.

DETAILED DESCRIPTION OF THE PREFERRED EMBODIMENTS

The present invention provides an electrodeless light source and is exemplified with the preferred embodiments in which CNTs are applied to light emitting material.

EXAMPLE 1

Figure 1:
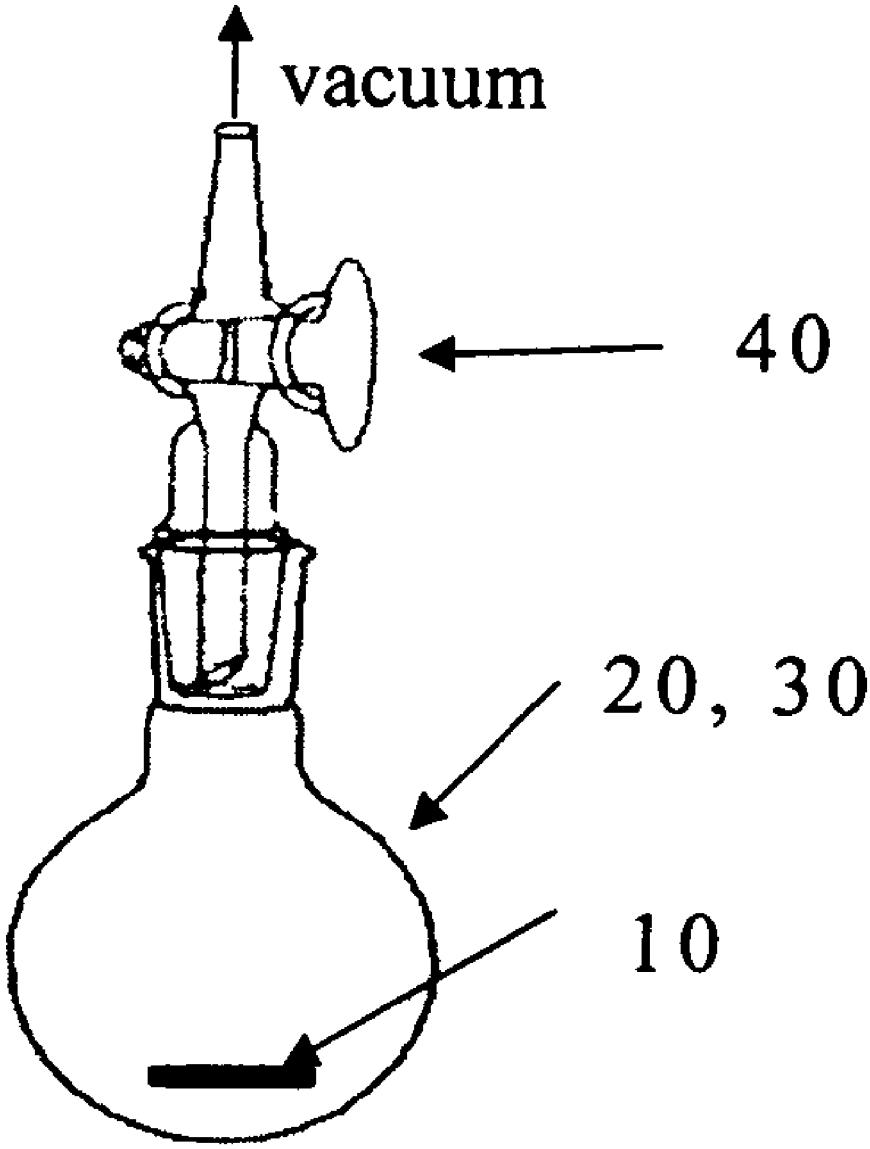
FIG. 1 shows the experimental installation used in Examples 1~4.
Figure 2:
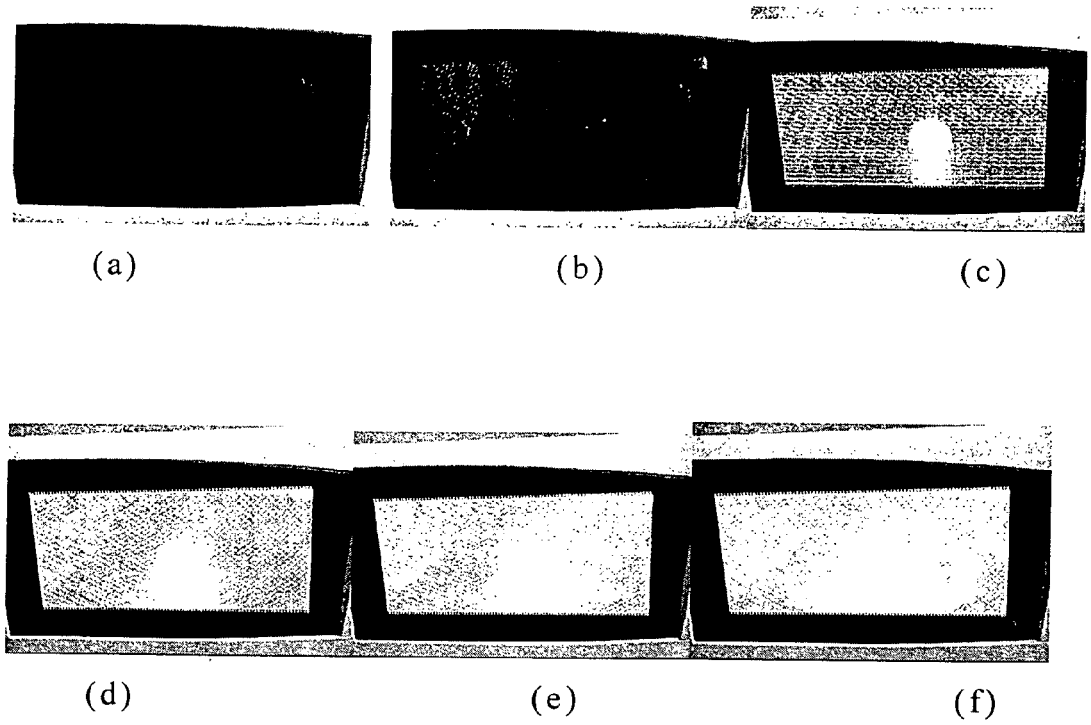
FIG. 2 shows the high-brightness white light emitted from the carbon nanotubes (CNTs).

The pressed CNTs 10 (5 mg) are fabricated on a cover glass, and put it in a flask 20. A vacuum flask 30 is provided to engage with the flask 20 by a seal screw 40, and then vacuumed to about 0.1~0.5 torr, as shown in FIG. 1. The flask is then placed on a carrier of a home microwave oven (2.45 GHz, 720 W). When the oven is turned on, high-brightness white light is continuously observed as shown in FIG. 2. Picture (a) shows the status of the oven before turned on; picture (b) indicates light emitted from a lamp built in the oven; and pictures (c)~(f) show the light continuously emitted from the CNTs. In order to identify rotation of the carrier, the flask is particularly laid down. The temperature of the flask is about 70° C. after radiation for 10 minutes.

EXAMPLE 2

Figure 3:
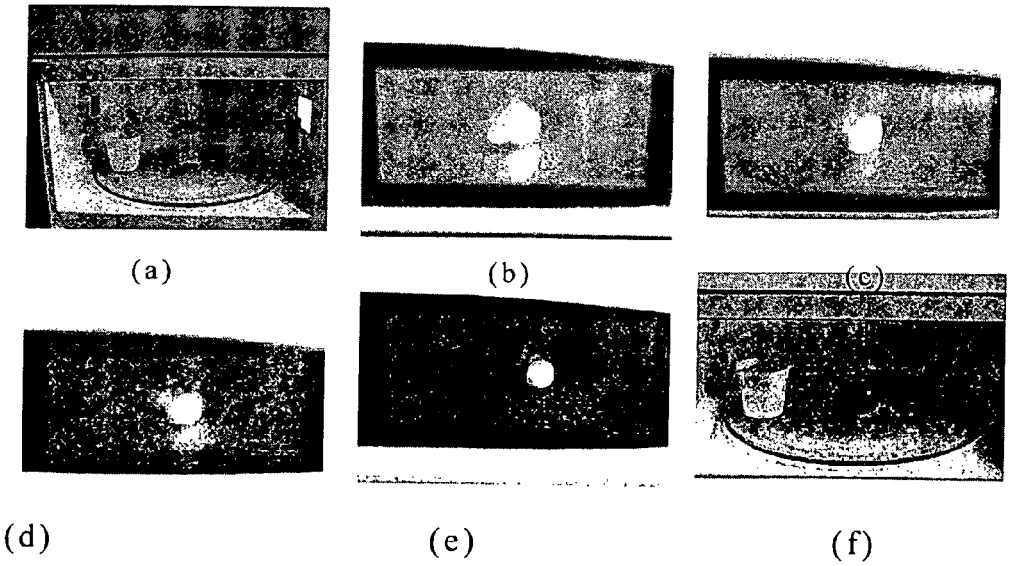
FIG. 3 shows the light emitted from the unpressed CNTs.

Repeat procedures of Example 1, but the CNTs are not pressed. When radiated with the microwave in vacuum, high-brightness white light is continuously observed as shown in FIG. 3. Picture (a) shows the status of the oven before turned on; pictures (b, c, d) show the high-brightness white light emitted from the CNTs rotating with the carrier after the oven is turned on. In the picture (e), as the CNTs are rotated to a farther position, the light source seems smaller. When the oven is turned off, no light emitted from the CNTs is observed as shown in picture (f).

EXAMPLE 3

Repeat procedures of Example 1, but the flask is contained into a trace of Ar (about 0.5 torr). When the CNTs are radiated with microwave in Ar, high-brightness purple light emitted from the plasma of Ar discharge is observed.

EXAMPLE 4

Repeat procedures of Example 3, but Ar is replaced with nitrogen. When the CNTs are radiated with microwave in nitrogen, high-brightness pink light emitted from the plasma of nitrogen discharge is observed.

EXAMPLE 5

Figure 4:
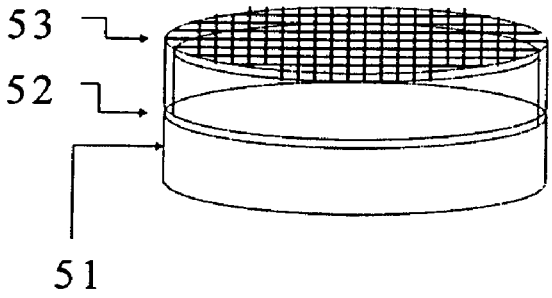
FIG. 4 shows the assembled lighting module containing CNTs.

FIG. 4 shows a light module containing the CNTs. Such assembly comprises a microwave radiation source 51, a membrane 52 formed by the CNTs and a shield 53 for blocking radiation. The membrane 52 overlaps the radiation source 51, and is covered with the shield 53. When the radiation source is activated, high-brightness white light can be observed.

Pretreatment of the CNTs

Before the procedures of the above Examples are carried out, the CNTs can be pretreated optionally. Through the pretreatment, the CNTs will be uniformly dispersed without changing electrical properties thereof. First, the CNTs are mixed with a proper surfactant, and then dispersed in an ultrasonic oscillator. The dispersed CNTs are quite stable even at 650° C., and have resistance about 1.0Ω as the surfactant is removed. The surfactant can be an anionic surfactant such as sodium dodecyl sulfate.

According to the above Examples, the electrodeless light source of the present invention is proved by radiating the CNTs in vacuum or a trace of gas. To know more characteristics about the present invention, the CNTs and light in Example 1 are analyzed.

1. Electrical Properties of the CNTs

Results of the related tests indicate that the CNTs have the same resistance and thermal stability before and after radiation.

2. Spectrum of the Light (1) Vacuum

Figure 5:
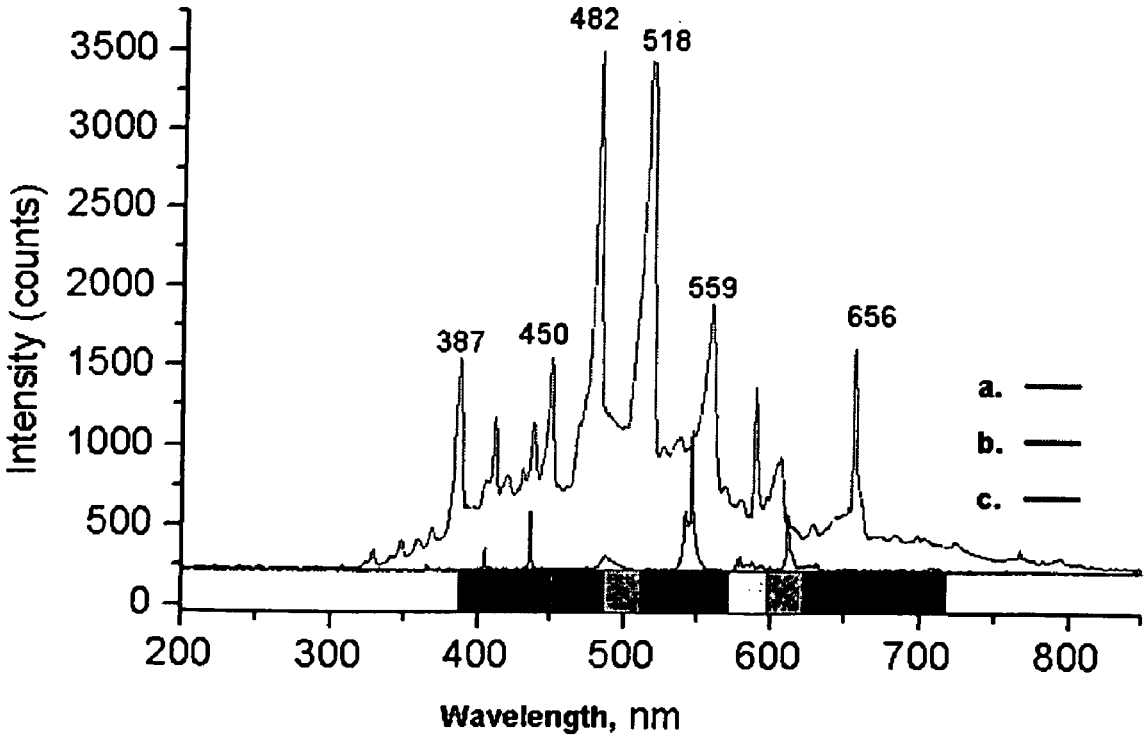
FIG. 5 shows the spectrum of the light emitted from the CNTs in vacuum.

Spectrum of the CNTs is analyzed with a spectrometer (USB2000 Miniature Fiber Optic Spectrometer, OceanOptics Inc.) and shown in FIG. 5. Peaks at wavelengths of 387, 415, 430, 445, 450, 482, 518, 559, 590, 606 and 656 nm are obvious and have widths about 4~14 nm. It's particularly surprising that the most obvious peaks are respectively located at 656 nm (red), 518 nm (green), 559 nm (green), and 482 nm (blue). So far as we know, no other solid light source capable of simultaneously emitting RGB color lights is found. Furthermore, for the light with spectrum peaks in such narrow-bands, perfect color rendering capabilities can be predicted.

Intensity of the light emitted from the CNTs of Example 1 is also compared to that of a conventional fluorescent lamp in the oven. Intensity of the fluorescent lamp outside the oven is about 6.45 times as high as that inside the oven. As shown in FIG. 5, intensity (spectrum a) of the CNTs is about 15 times as high as intensity (spectrum b) of the lamp (25,000 cd/$m^2$). That is, intensity of light generated in Example 1 is similar to that of fifty standard lamps (100 watt). Spectrum c is baseline calibration for US2000-UV-V is instrument.

(2) Plasma

Figure 6:
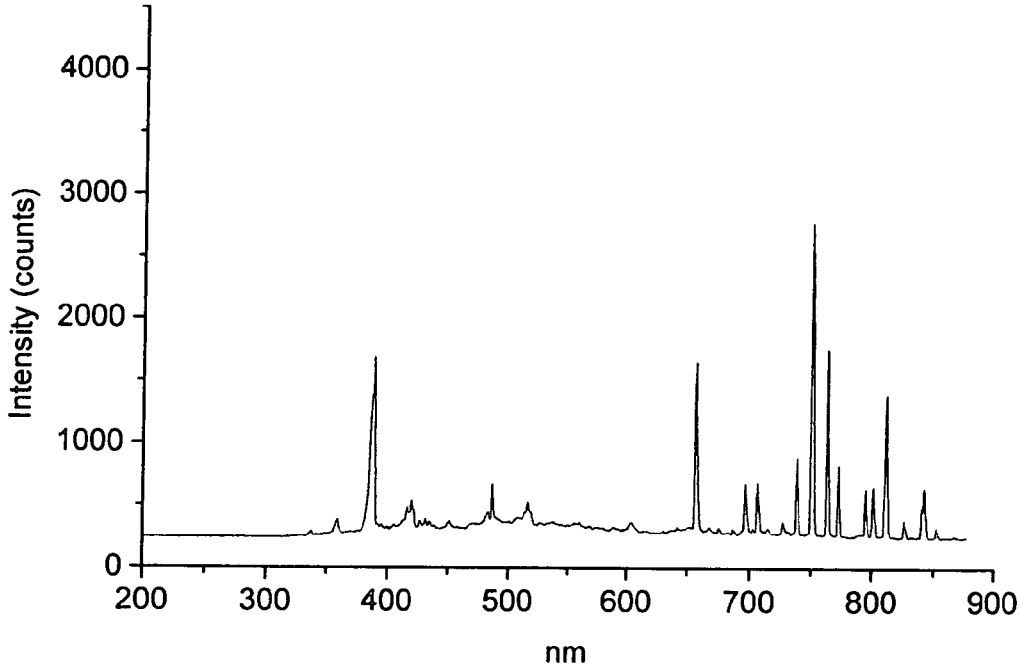
FIG. 6 shows the spectrum of the light emitted from the CNTs in plasma of inert gas Ar molecule.
Figure 7:
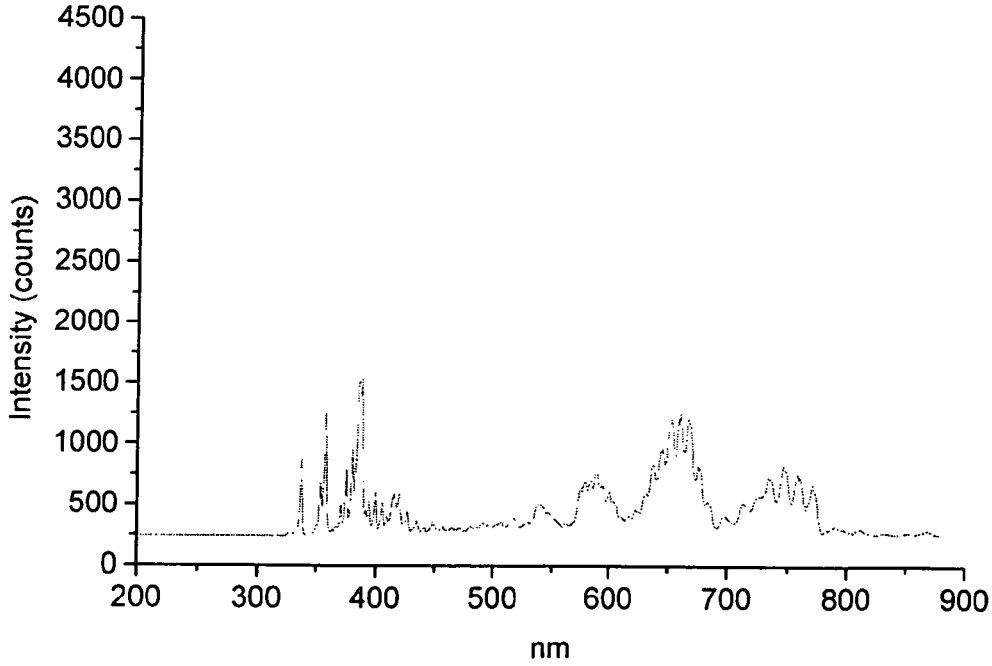
FIG. 7 shows the spectrum of the light emitted from the CNTs in plasma of nitrogen.

FIGS. 6 and 7 respectively show the spectra of Examples 3 and 4, which indicate the plasma effect can be achieved in a trace of gas at about $10^{-1}$~100 torr. Therefore, the present invention also provides a plasma source which can be easily obtained at a lower cost.

3. Chromaticity Analysis

Figure 8:
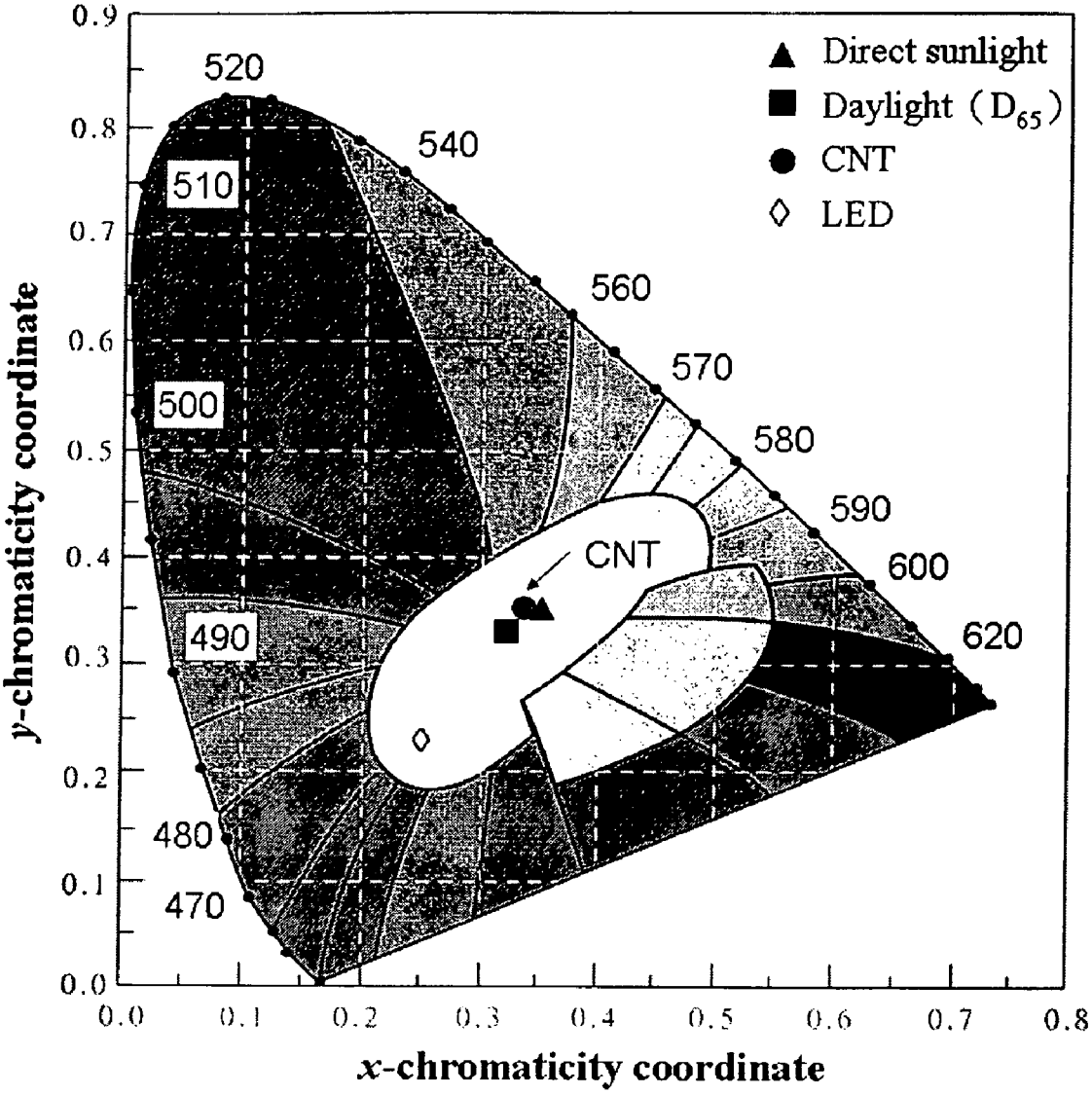
FIG. 8 shows the chromaticity coordinates of the light emitted from the CNTs.

Color rendering capability is one of the most important characteristics for a light source. It is known that the true color of an emitting object can be quantitatively assessed in terms of chromaticity coordinates. The chromaticity coordinates (x, y) according to CIE 1931 and conducted by a colorimeter (Topcon BM-7), are shown in FIG. 8. As a result, x- and y-chromaticity coordinates of the CNTs are in a ranges of 0.25~0.40 and 0.25~0.35, respectively. This measurement clearly shows that the CNTs can be attributed to a pure white-light source. It also indicates that the CNTs lighting has great color stability and do not suffer in chromaticity and color rendering.

Figure 9:
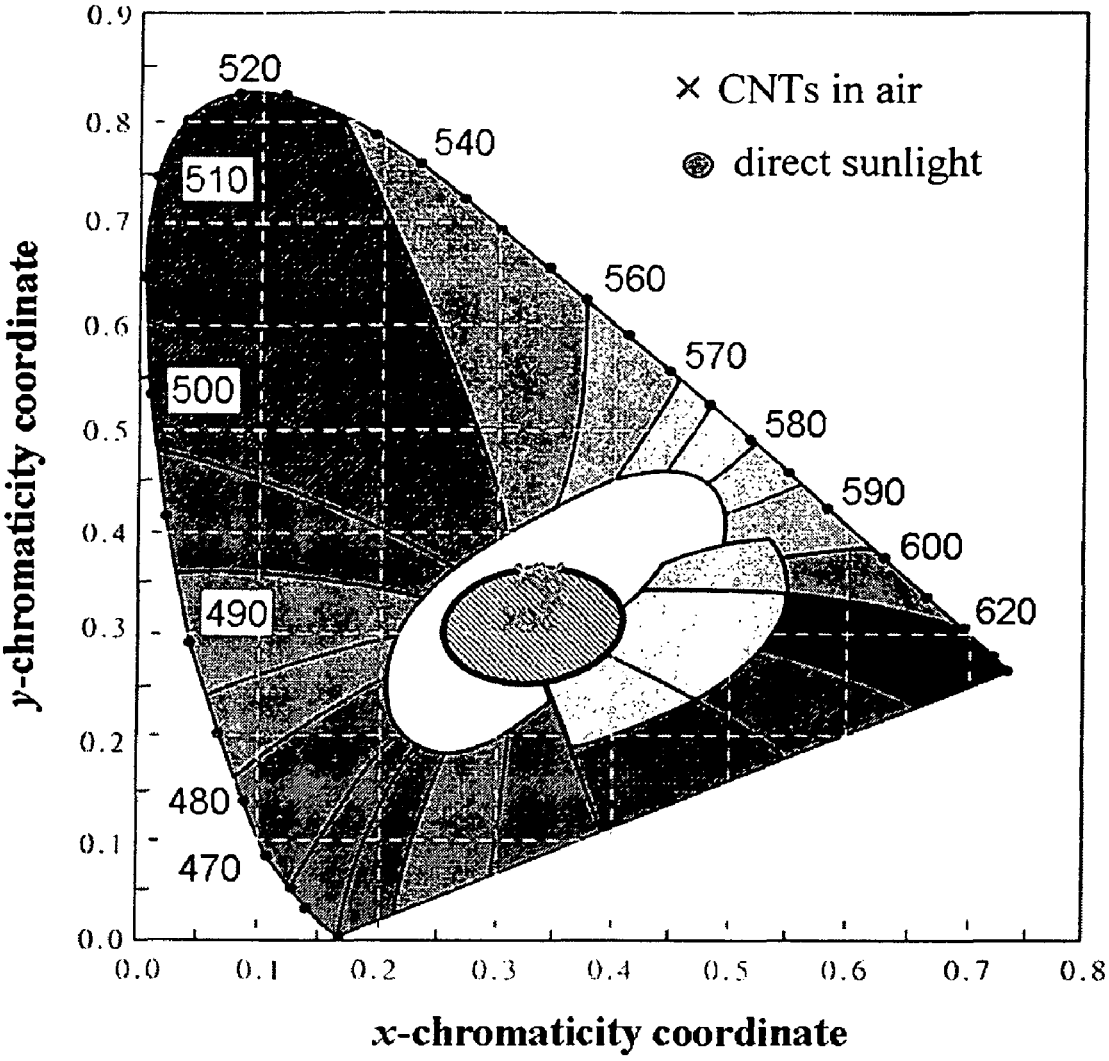
FIG. 9 shows the chromaticity coordinates of sun light and the light emitted from the CNTs.

In FIG. 9, chromaticity coordinates of the CNTs light source are compared to those of the sun, and the results indicate they are similar to each other. In other words, the electrodeless light source of the present invention can emit "very pure" white light, even more than LED.

Figure 10:
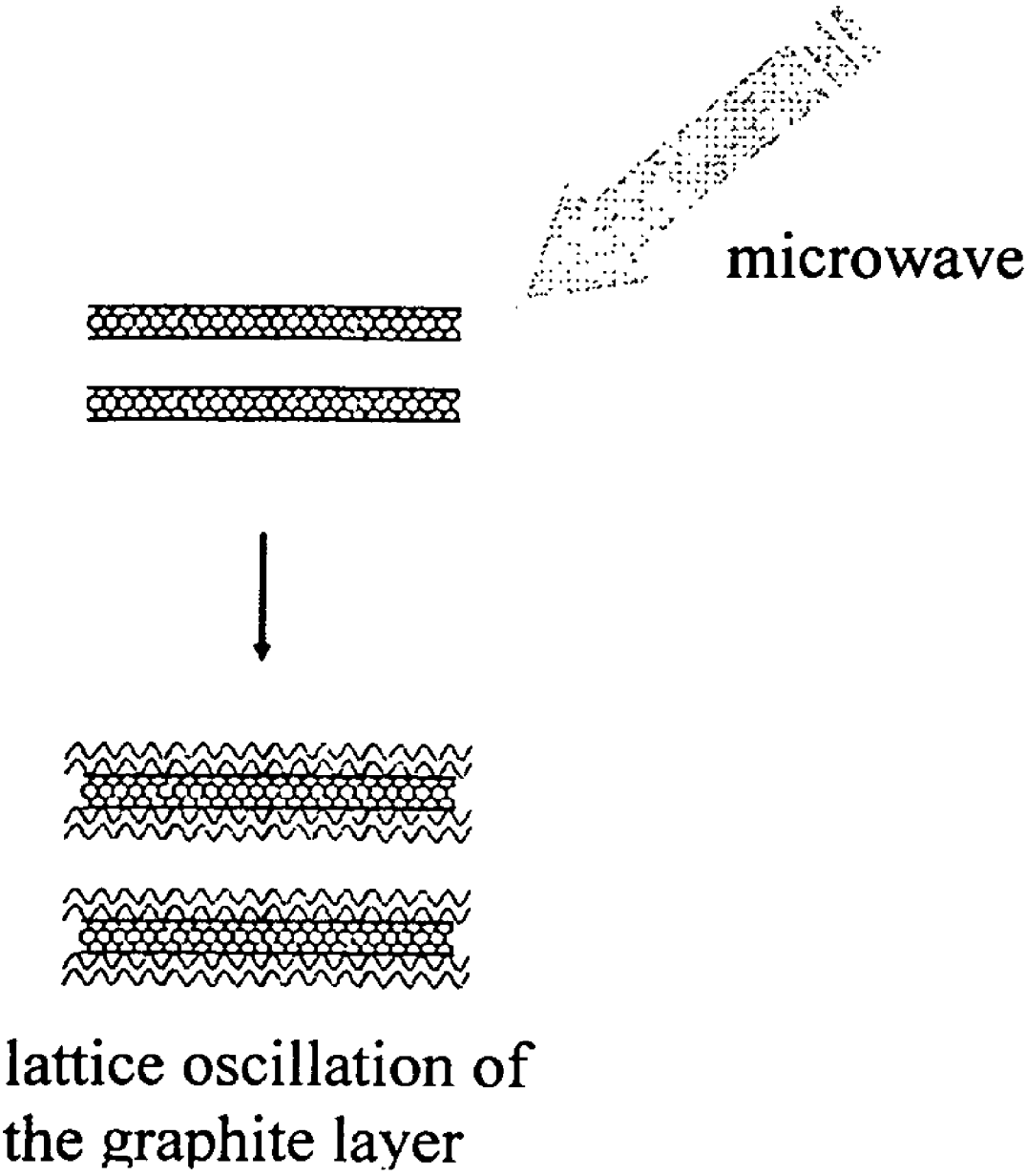
FIG. 10 shows the possible reason for light emitted from the CNTs.

The electrodeless light source of the present invention is a breakthrough in the field of lighting and never found before. FIG. 10 indicates that lattice oscillation of graphite layer due to electron exciting may be the reason for emitting light from an electrically conductive inorganic carbide such as CNTs.

According to the preferred embodiments, features of the present invention can be summarized as follows:

1. The CNTs light source can emit high-brightness lighting emission comprising individual RGB tri-chromaticity colors with narrow-bands in vacuum, and therefore be suitable for illumination and display.

2. The present invention provides a light source without mercury or other consumptive electrodes required for conventional light sources.

3. There is no obvious thermal-radiation effect during lighting, i.e., the efficiency of conversion from microwave into light is high and suitable for commercialization.

4. Wavelengths of the light emitted from the CNTs are ranged from 387 nm to 656 nm and beyond the UV light, and therefore is harmless to the human body.

While the present invention is exemplified with the preferred embodiments, spirit and scope of the present invention should not be limited therein. Any slight modification according to these embodiments should be also belonged to the present invention.

What is claimed is:

1. An electrodeless light source, comprising a microwave source and carbon nanotubes, wherein said carbon nanotubes are in an inert gas or nitrogen having a pressure about 0.1~1.0 torr.

2. The electrodeless light source as claimed in claim 1, wherein said microwave source is controlled at about 1~1,000 watt per gram of said carbon nanotubes.

3. The electrodeless light source as claimed in claim 1, wherein said inert gas or nitrogen generates plasma.

4. The electrodeless light source as claimed in claim 1, wherein said inert gas or nitrogen is about 0.5 torr.

5. The electrodeless light source as claimed in claim 1, wherein said inert gas is Ar.

* * * * *